United States Patent [19]

Mode

[11] Patent Number: 4,489,879

[45] Date of Patent: Dec. 25, 1984

[54] MULTI-COMPARTMENTED FOOD SERVING TRAY AND BLANK THEREFOR

[75] Inventor: Duane R. Mode, Bloomington, Minn.

[73] Assignee: Champion International Corporation, Stamford, Conn.

[21] Appl. No.: 498,137

[22] Filed: May 25, 1983

[51] Int. Cl.[3] ..... B65D 5/48

[52] U.S. Cl. ..... 229/27; 229/8; 229/15; 229/33

[58] Field of Search ..... 229/33, 27, 15, 8, 28 R, 229/52 AC; 206/561-565

[56] References Cited

U.S. PATENT DOCUMENTS

| | | | |
|---|---|---|---|
| 1,125,175 | 1/1915 | Rey | 229/15 X |
| 1,975,453 | 10/1934 | Fink | 229/52 AR |
| 2,382,844 | 8/1945 | Arneson | 229/27 X |
| 2,512,963 | 6/1950 | Peiker | 206/563 X |
| 2,837,266 | 6/1958 | Sarnoff | 229/52 AC X |
| 3,084,843 | 4/1963 | Urban | 229/8 X |
| 3,107,039 | 10/1963 | Painter | 229/28 R |
| 3,174,674 | 3/1965 | Wagner | 206/564 X |
| 3,324,998 | 6/1967 | Farquhar | 206/45.14 X |
| 3,369,724 | 2/1968 | Ettlinger | 206/562 X |

FOREIGN PATENT DOCUMENTS

| | | | |
|---|---|---|---|
| 807106 | 10/1936 | France | 229/27 |
| 590288 | 4/1959 | Italy | 229/28 R |

*Primary Examiner*—William T. Dixson, Jr.
*Assistant Examiner*—Gary E. Elkins
*Attorney, Agent, or Firm*—Evelyn M. Sommer

[57] ABSTRACT

A multi-compartmented food serving tray having a plurality of food-receiving compartments therein for holding food. One end of the tray has a cup holding assembly having portions movable from a position to permit a cup to be carried upright when the tray is closed and capable of being carried to a position to permit the cup to be placed in a food-receiving compartment when the tray is open and the contents thereof are ready to be consumed.

21 Claims, 7 Drawing Figures

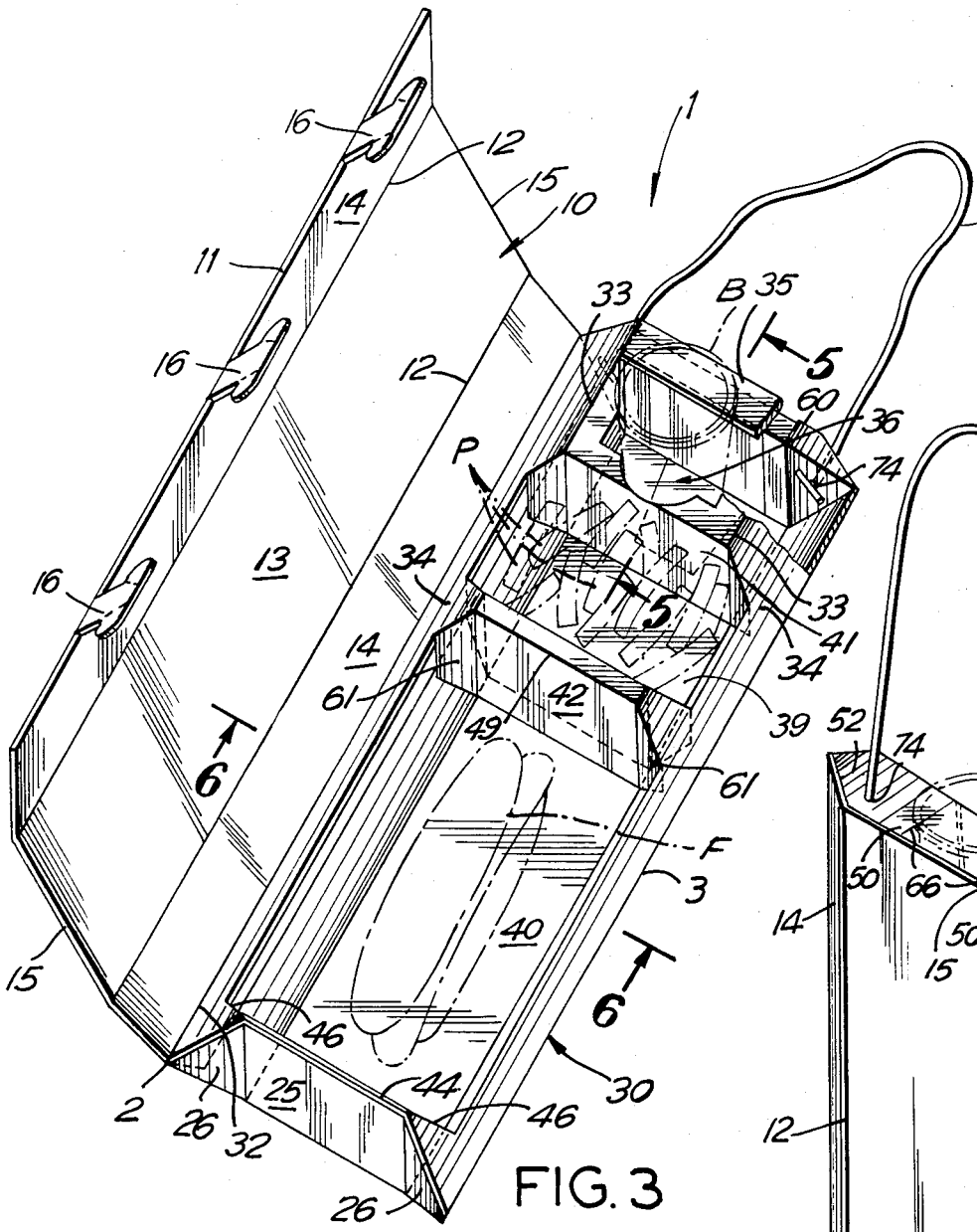
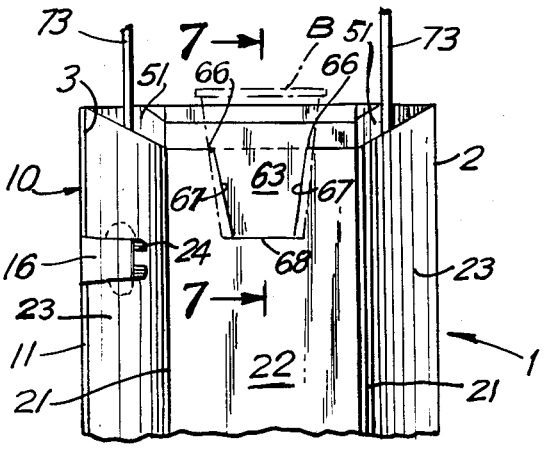
FIG. 4
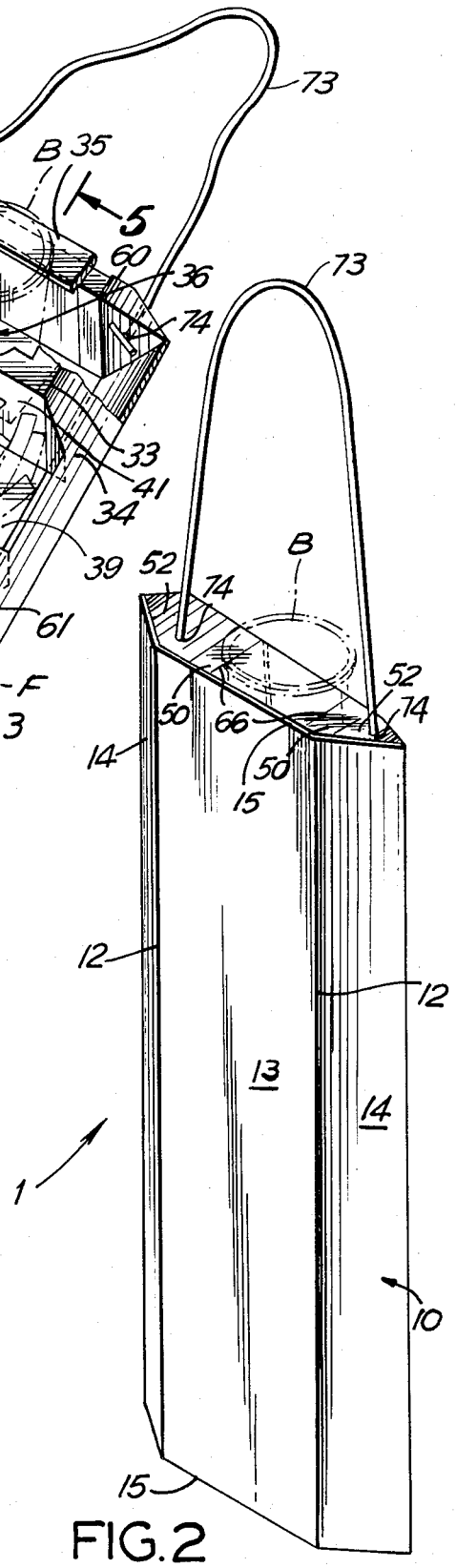
FIG. 2

MULTI-COMPARTMENTED FOOD SERVING TRAY AND BLANK THEREFOR

BACKGROUND OF THE INVENTION

The present invention relates to a multi-compartmented food serving tray and more particularly to a multi-compartmented food serving tray which is adapted to normally lie flat and to be erected when ready to be used.

There are a number of multi-compartmented serving trays in use. Such trays are used to receive and carry food at sporting events, merchandising shows, etc. Such serving trays comprise a series of openings adapted to receive food. They are usually carried from the serving counter to the place where the food or beverage is to be consumed. The food is placed in one or more compartments and a beverage cup is adapted to stand in another compartment.

Some serving trays presently in use do not have a cover so that the food gets cold in transit from the serving counter to the eating area. In addition, carrying both the tray and a beverage cup in open trays is difficult, awkward and sometimes causes spillage of either the beverage, the food or both. Some trays presently in use are provided with a cover which is closed to keep the food warm. However, such trays do not provide for means for carrying a beverage cup. Hence, even with existing covered trays, beverage cups must still be carried separately.

BRIEF DESCRIPTION OF THE INVENTION

The present invention avoids these drawbacks and has for one of its objects the provision of an improved covered compartmented serving and carrying tray which permits a beverage cup or beverage container of rectangular form and food to be carried simultaneously.

Another object of the present invention is the provision of an improved covered serving tray which is made from a one-piece blank and which is foldable to form a compartmented tray.

Another object of the present invention is the provision of an improved covered serving tray which has food compartments as well as means to permit a beverage cup to be carried while the cover is closed.

Other and further objects of the invention will be obvious upon an understanding of the illustrative embodiment about to be described, or will be indicated in the appended claims, and various advantages not referred to herein will occur to one skilled in the art upon employment of the invention in practice.

In order to accomplish these objects the present invention comprises a container made from a one-piece blank having a bottom wall with a top wall and a cover hingedly connected thereto. The bottom and top walls are adapted to be folded over and adhered to each other to form the main body of the container. Spacers are provided in the top wall which are adapted to be folded downwardly when the tray is erected to keep the top wall spaced above the bottom wall and to simultaneously form separate food-receiving compartments.

At one end of the blank, the bottom wall is provided with a beverage cup-supporting assembly which is foldable from a position where it supports a cup in an upright position (when the tray is closed and is to be carried) to a position where it is flush with the bottom wall to support a beverage cup in a food compartment (when the tray is opened for use).

BRIEF DESCRIPTION OF THE DRAWINGS

A preferred embodiment of the invention has been chosen for purposes of illustration and description and is shown in the accompanying drawings forming a part of the specification, wherein:

FIG. 2 is a perspective view showing the tray in a folded position ready to be carried.

FIG. 3 is a perspective view showing the tray in its open position ready to be used to consume food.

FIG. 4 is a fragmentary rear elevational view showing a cup being carried by the tray when the tray is in its closed position.

DESCRIPTION OF THE INVENTION

Figure 1:
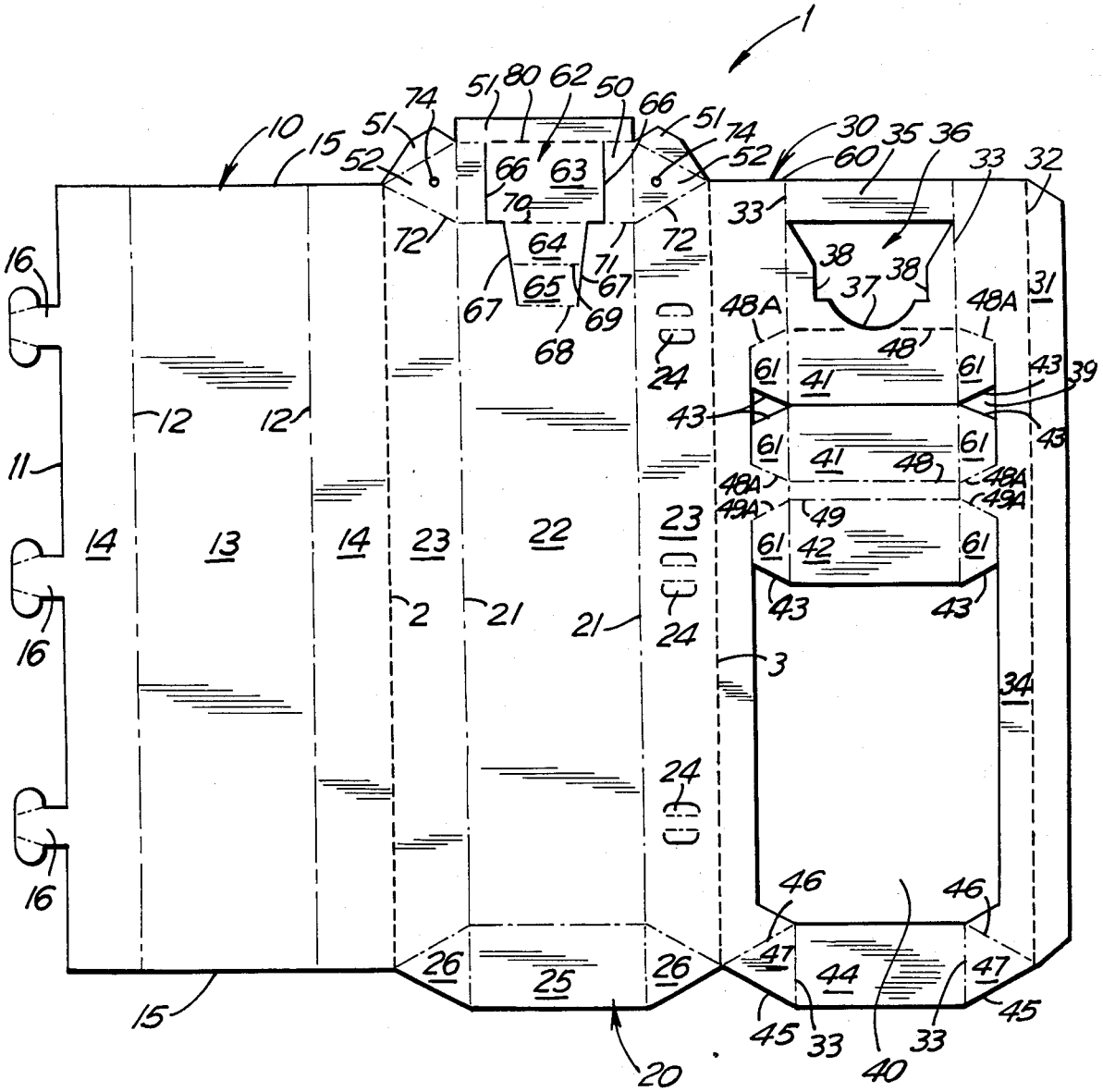
FIG. 1 is a plan view of a one-piece blank from which the tray of the present invention is formed.

Referring more particularly to FIG. 1 of the drawings, the serving tray 1 is formed from a one-piece blank made from a paper board which may be die cut and scored by automatic machinery. The blank 1 comprises a cover panel 10, a bottom wall panel 20, hingedly connected to each other along a fold line 2, and a top wall panel 30 hingedly connected to bottom wall panel 20 along a fold line 3.

The cover panel 10 has an outer edge 11 and opposed end edges 15. A pair of longitudinally extending parallel fold lines 12 are spaced equally inwardly from the edge 11 and fold line 2 to divide the cover panel 10 into central panel 13 and substantially identical side panels 14. The outer edge 11 thereof has a plurality of lock tabs 16 extending therefrom.

The top wall panel 30 has an outer glue flap 31 extending from and foldable relative thereto along longitudinal fold line 32 and has a pair of longitudinal fold lines 33 to divide the top panel 30 into side and central portions 34 and 35, respectively. The fold lines 33 are equidistant from fold lines 3 and 32 so that the side panels are substantially identical. The top wall panel 30 has an end edge 60 which is preferably perpendicular to fold lines 33. The opposite end of the top wall panel 30 is provided with an end wall panel 44 adapted to be folded down along fold line 46. The end wall panel 44 has opposed angled edges 45 and the fold lines 46 are correspondingly angled to form triangular extensions 47 extending from each fold line 33.

Figure 5:
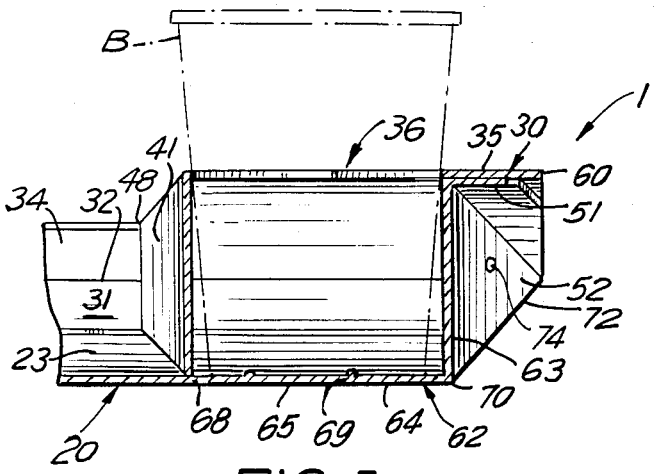
FIG. 5 is a sectional view taken along line 5—5 of FIG. 3.
Figure 6:
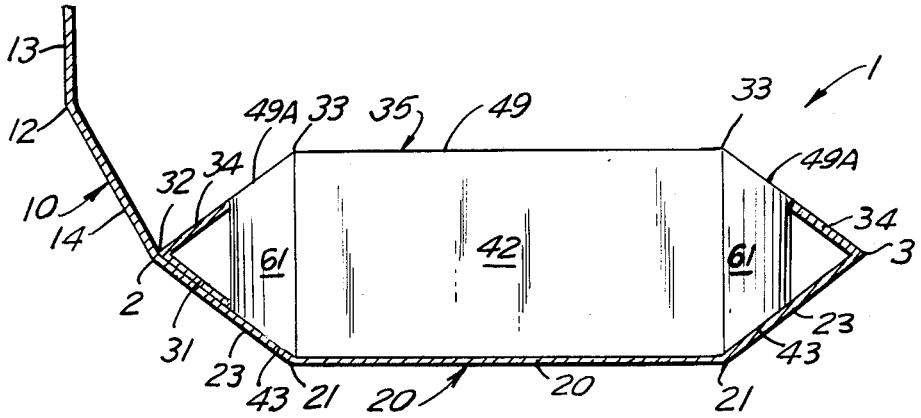
FIG. 6 is a sectional view taken along line 6—6 of FIG. 3.

The top wall panel 30 is provided with a plurality of food-receiving openings 36, 39 and 40 to receive different foods, such as potatoes P and frankfurters F. The food-receiving opening 36 adjacent the edge 60 also serves as a cup-receiving opening to receive a beverage cup B therein, as shown in FIGS. 3 and 5. The cup-receiving opening 36 has a curved portion 37 and spaced rectangular (right angled) portions 38 to permit either a round or a rectangular cup to be received therein.

The edges 48—48 and 49 of openings 39 and 40, respectively, are provided with spacer panels 41—41 and 42, respectively, which are to be folded substantially vertically downwardly from the top wall panel 30 when the tray is erected to form the food-receiving compartments 39 and 40. The spacer panels 41 and 42 have angled outer edges 43 and have angled fold lines 48A and 49A to form truncated triangular extensions 61 extending from and foldable relative to each fold line 33.

The bottom wall panel 20 is provided with a pair of longitudinally extending fold lines 21 also spaced inwardly from the fold lines 2 and 3 by equal distances to form a central panel 22 and substantially identical side panels 23. Notches 24 are provided in the side panel 22 adjacent fold line 3 to receive the lock tabs 16 of the cover panel 10. The edge of the bottom wall panel 20 is provided with a end wall panel 25 having triangular side extensions 26 adapted to be folded vertically and to be adhered to the lower end wall panel 44 of the top wall panel 30 when the tray is formed. The end wall panel 25 and its side extensions 26 of the bottom wall panel 20 are substantially similarly shaped to the end wall panel 44 and its side extensions 47 of the top wall panel 30.

The bottom wall panel 20 has an end wall panel 50 with triangular side extensions 52 extending therefrom and with end flaps 51 extending therefrom and foldable relative thereto. The end wall panel 50 is adapted to be folded down along fold lines 71 and 72 so that the end flaps 51 may be attached along the top edge 60 of the top wall panel 30.

The bottom wall panel 20 has a cup-supporting assembly 62 which comprises a top cup-support portion 63, which is part of and normally flush with the end panel 50, and a pair of bottom cup-support portions 64 and 65 which are part of and normally flush with the bottom wall panel 20. The top cup-support portion 63 is formed by a pair of opposed slits 66 in the upper end wall panel 50 and bottom cup-support portions 64–65 are formed by a pair of preferably angled slits 67 in the bottom wall panel. The top and bottom cup-support portions 64 to 66 are foldable at right angles to each other along fold line 70 which is coextensive with fold line 71 for the end wall panel 50. The top cup-support is foldable relative to the end wall panel 50 along fold line 80 (which is also the fold line for the end flap 57) and the bottom cup-support panel 20 is foldable relative to the bottom wall panel along fold line 68.

Figure 7:
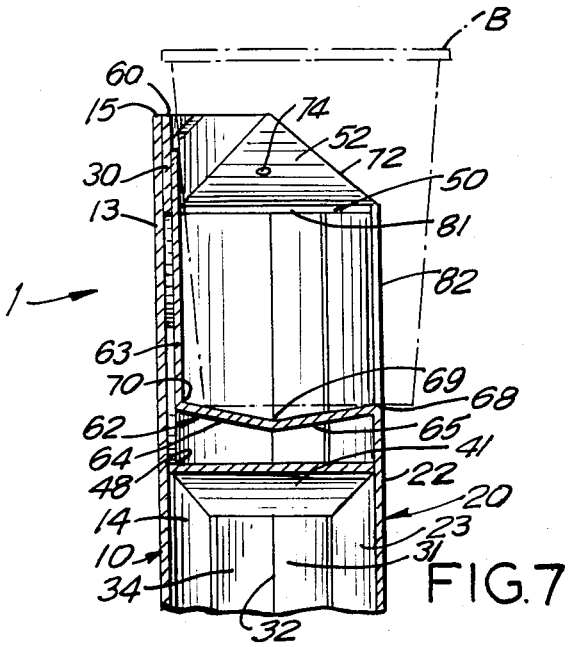
FIG. 7 is a sectional view taken along line 7—7 of FIG. 4.

The top cup-support portion 63 and bottom cup-support portions 64–65 are normally adapted to lie flat and flush with wall panel 50 and bottom wall panel 20, respectively, as shown in FIG. 5 in order to support a cup B which has been inserted through opening 36, when the tray is open and ready for use. The top and bottom support portions 63 to 65 are foldable inwardly along lines 68, 70 and 80, as shown in FIGS. 3 and 7, to a position at right angles to bottom and end wall panels 22 and 50, respectively, to permit the cup B to be carried upright when the tray is closed. A carrying handle or string 73 may extend from openings 74 in the end wall panel extensions 52 to permit the tray to be carried upright.

The tray is initially assembled by folding the top wall panel 30 over the bottom wall panel 20 along fold line 3. The cup-receiving opening 36 in the top wall panel overlies the cup-supporting assembly 62 in the bottom wall panel. In this position, the tray may lie flat and is ready for shipment and storage until it is to be used.

When the tray is to be erected, the various spacers 41 to 44, as well as upper and lower end wall panels 50 and 42–25 are folded at right angles to bottom and top wall panels 20 and 30, respectively. The lower end wall panels 44 and 25 are attached to each other, as by stapling, and the end panel 31 of top wall panel 31 is folded inwardly and attached to the inner surface of the bottom wall 20 along fold line 2. The upper end wall panel 50 is folded down and its end flaps 51 are attached to the top wall panel 30 along the top edge 60. The lower edges of the spacers 41 to 42 abut the bottom wall panel 20 in order to keep the top wall panel 30 spaced above the bottom wall panel 60 and to simultaneously form compartments 36, 39 and 40. The spacers 41 to 43, as well as end wall panels 25, 44 and 50 are similarly shaped and are the same height so that they keep the bottom wall panel 30 and the top wall panel 20 parallel to each other. The longitudinal fold lines 21 and 32 will enable the tray to assume a six-sided pillow configuration.

If desired, the lower end wall panels 25 and 44 can be adhered to each other and the upper end flaps 51 can be adhered to the upper edge of the top wall by the manufacturer. However, in this case, the tray will not lie flat. However, the invention could still be used with the tray in this position.

After the tray is erected, food is placed in the compartments 40 and 39, the cover panel 10 is folded over the top wall panel 30 with the tabs 16 inserted in the openings 24 to keep the tray closed. The cup-supporting assembly 62 is folded inwardly, as shown in FIGS. 4 and 7, to create cup-receiving cavities 81 and 82 in the upper end wall 50 and in the bottom wall 20, respectively. The bottom cup-support portions 64–65 form a cup-support ledge within the tray (FIG. 7) so that the beverage cup B can be carried in an upright position. Thus, when the tray is closed, a cup B, as well as the tray, may be carried together with one hand with the cup B in an upright position, as shown in FIG. 2.

When it is time to consume the food, the cup is removed from the cup-support ledge 64–65 (FIG. 7) and the cover 10 is opened. The cup-supporting assembly 62 is then moved outwardly, as shown in FIGS. 3 and 5, so that its bottom cup-support portions 64–65 are flush with bottom wall panel 22 and its top cup-support portion 63 is flush with the top wall panel 50 (FIG. 5). A cup B can now be inserted into the compartment 36 through the top wall 30, as shown in FIGS. 3 and 5. As noted above, the cup B may be either round or square and it will still be received in this compartment 36.

It will thus be seen that the present invention provides an improved one-piece foldable compartmented serving and carrying tray which permits a beverage cup to be carried and at the same time also permits the beverage cup to stand in one of the compartments.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A one-piece tray comprising a bottom wall and a top wall having longitudinal side edges and an end edge perpendicular to said longitudinal side edges, said bottom and top walls being hingedly connected to each other along a longitudinal side edge in overlying relationship to each other, said bottom wall having an end spacer wall panel adapted to be folded relative thereto to space the top wall from the bottom wall, said top wall having a plurality of food-receiving openings therein, additional spacer means foldable relative to and extending from at least one of said walls and adapted to space the top wall above the bottom wall, one of said food-receiving openings comprising a cup-receiving opening, said bottom wall and end spacer wall having a cup-supporting assembly formed therein underlying said cup-receiving opening, said cup-supporting assembly comprising a pair of opposed longitudinally oriented slits in said bottom and end spacer walls connected together by a pair of first and second transverse fold lines, said first transverse fold lines being in said bottom wall and said second transverse fold lines being in said end spacer wall, a third transverse fold line in said cup-supporting assembly intermediate said first and second transverse fold lines to form top and bottom cup-support portions foldable relative to each other along said transverse fold lines, said top cup-support portion being movable from a position flush with the end spacer wall to a position adjacent the top wall to form an opening in the end spacer wall, and the bottom cup-support portion movable from a position flush with the bottom wall, to support a cup in said cup-receiving opening, to a position within the tray at an angle to said top wall to form a ledge to support a cup extending through the opening in the end spacer wall.

2. A tray as claimed in claim 1 wherein the upper end wall is foldable relative to the bottom wall along a fold line which is coextensive with the fold line in the cup-support assembly connecting the top and bottom cup-support portions.

3. A tray as claimed in claim 2 wherein said end spacer end wall has end flaps foldable relative thereto along a fold line and adapted to be attached to the top wall adjacent its top edge and wherein the end flap fold line is coextensive with the top cup-support portion fold line.

4. A tray as claimed in claim 3 wherein the opposed slits in the bottom wall are angled relative to each other.

5. A tray as claimed in claim 4 wherein the top and bottom walls are provided with end walls adapted to be folded relative thereto and to be attached to each other.

6. A tray as claimed in claim 5 wherein the cup-receiving opening is contoured for receiving a round cup or a rectangular cup.

7. A tray as claimed in claim 6 wherein said opening has a curved portion as well as rectangular portions.

8. A tray as claimed in claim 7 wherein said spacer means are shaped similarly to each other and are adapted to fold downwardly from an edge of at least some of the food openings in said top wall to form separated food compartments.

9. A tray as claimed in claim 8 wherein longitudinal fold lines are provided on the top and bottom walls to give the tray a six-sided pillow configuration when erected.

10. A tray as claimed in claim 9 wherein a cover is hingedly connected to the other edge of the bottom wall and is foldable relative thereto.

11. A tray as claimed in claim 10 wherein carrying means are provided to carry said tray in its closed position.

12. A one-piece blank for a tray comprising a bottom wall panel and a top wall panel having longitudinal side edges and an end edge perpendicular to said longitudinal side edges, said bottom and top wall panels being hingedly connected to and foldable relative to each other along a longitudinal side edge into overlying relationship to each other, said bottom wall panel having an end spacer wall panel adapted to be folded relative thereto to space the top wall panel from the bottom wall panel, said top wall panel having a plurality of food-receiving openings therein, additional spacer means foldable relative to and extending from at least one of said wall panels, one of said food-receiving openings comprising a cup-receiving opening, said bottom wall panel and end spacer wall panel having a cup-supporting assembly formed therein adapted to underlie said cup-receiving opening, said cup-supporting assembly comprising a pair of opposed longitudinally oriented slits in said bottom and end spacer wall panels connected together by a pair of first and second transverse fold lines, said first transverse fold lines being in said bottom wall and said second transverse fold lines being in said end spacer wall, a third transverse fold line in said cup-supporting assembly intermediate said first and second transverse fold lines to form top and bottom cup-support portions foldable relative to each other along said transverse fold lines, said top cup-support portion being movable from a position flush with the end spacer wall panel to a position adjacent the top wall panel to form an opening in the end spacer wall panel, and the bottom cup-support portion movable from a position flush with the bottom wall panel adapted to support a cup in said cup-receiving opening, to a position within the tray at an angle to said top wall panel to form a ledge adapted to support a cup extending through the opening in the end spacer wall panel.

13. A blank as claimed in claim 12 wherein the upper end wall panel is foldable relative to the bottom wall panel along a fold line which is coextensive with the fold line in the cup-support assembly connecting the top and bottom cup-support portions.

14. A blank as claimed in claim 13 wherein said end spacer end wall panel has end flap panels foldable relative thereto along a fold line and adapted to be attached to the top wall panel adjacent its top edge and wherein the end flap fold line is coextensive with the top cup-support portion fold line.

15. A blank as claimed in claim 14 wherein the opposed slits in the bottom wall panel are angled relative to each other.

16. A blank as claimed in claim 15 wherein the top and bottom wall panels are provided with end wall panels adapted to be folded relative thereto and to be attached to each other.

17. A blank as claimed in claim 16 wherein the cup-receiving opening is contoured for receiving a round cup or a rectangular cup.

18. A blank as claimed in claim 17 wherein said opening has a curved portion as well as rectangular portions.

19. A blank as claimed in claim 18 wherein said spacer means are shaped similarly to each other and are adapted to fold downwardly from an edge of at least some of the food openings in said top wall panel to form separated food compartments.

20. A blank as claimed in claim 19 wherein longitudinal fold lines are provided on the top and bottom wall panels to give a tray formed therefrom a six-sided pillow configuration when erected.

21. A blank as claimed in claim 20 wherein a cover panel is hingedly connected to the other edge of the bottom wall panel and is foldable relative thereto.

* * * * *